US006208306B1

(12) United States Patent
McLean et al.

(10) Patent No.: US 6,208,306 B1
(45) Date of Patent: Mar. 27, 2001

(54) COMPACT, BROADBAND ANTENNAS BASED ON FOLDED, TOP-LOADED BROADBAND DIPOLES WITH HIGH-PASS TUNING ELEMENTS

(75) Inventors: James S. McLean; Gentry E. Crook, both of Austin, TX (US)

(73) Assignee: EMC Automation, Inc., Cedar Park, TX (US)

( * ) Notice: Subject to any disclaimer, the term of this patent is extended or adjusted under 35 U.S.C. 154(b) by 0 days.

(21) Appl. No.: 09/293,008

(22) Filed: Apr. 16, 1999

Related U.S. Application Data

(60) Provisional application No. 60/081,984, filed on Apr. 16, 1998.

(51) Int. Cl.[7] ..... H01Q 1/48
(52) U.S. Cl. ..... 343/747; 343/795
(58) Field of Search ..... 343/747, 752, 343/745, 795, 846, 810

(56) References Cited

U.S. PATENT DOCUMENTS 5,926,150 * 7/1999 McLean et al. ..... 343/846

* cited by examiner

*Primary Examiner*—Tan Ho
*Assistant Examiner*—James Clinger
(74) *Attorney, Agent, or Firm*—Darby & Darby

(57) ABSTRACT

A compact, electrically-small broadband antenna which combines a folded, top-loaded antenna geometry using broadband radiating elements with a series capacitance applied at the antenna feed is provided. The antenna can be used alone or in combination with a frequency-independent antenna such as a log-periodic dipole array. Additional antenna elements may also be included to improve the transition between the antenna and such a frequency-independent antenna. Similar performance may be obtained with either balanced or single-ended versions of the antenna

22 Claims, 6 Drawing Sheets

COMPACT, BROADBAND ANTENNAS BASED ON FOLDED, TOP-LOADED BROADBAND DIPOLES WITH HIGH-PASS TUNING ELEMENTS

RELATED APPLICATIONS

This application claims the benefit of United States Provisional Patent Application Number 60/081,984, filed on Apr. 16, 1998.

BACKGROUND OF THE INVENTION

1. Field of the Invention

The present invention relates generally to antennas, and more particularly to compact, broadband antennas utilizing a combination of folding and top-loading techniques.

2. Description of the Related Art

Frequency-independent antenna designs, in particular log-periodic dipole arrays (LPDAs), are widely used for broadband electric field generation applications. However, at the lower end of their operating range (the frequency range over which they exhibit frequency-independent behavior), such antennas must be approximately one-half wavelength in width. Thus, an LPDA with a lower operating frequency of 30 MHz (10 meter wavelength) must be approximately 5 meters wide. Because such dimensions are unacceptably large and because operating frequency ranges extending from below 20 MHz to above 2 GHz are required by the EMC testing industry, design techniques for a reduced-size hybrid antenna have been sought.

Reducing the size of an antenna such that its dimensions are smaller than one-half of a wave-length at its operating frequency may be described as making the antenna "electrically small". Electrically small antennas are typically defined as those which fit within a sphere having a radius of $\frac{1}{2}\pi$ wave-lengths. Electrically small antennas are inherently more narrowband and inefficient than larger antennas, making design of compact antennas at relatively low frequencies challenging.

One common technique for extending the frequency range of an LPDA while limiting its size is the use of a broadband dipole to replace the lowest frequency element in the LPDA. For example, Brown-Woodward or bowtie dipoles can be used in conjunction with a 150 MHz LPDA (one having a low-frequency operating limit of 150 MHz) to extend the response of the antenna system down to 30 MHz. Examples of such a design are the model 3142 and 3143 antennas available from EMC Test Systems, L.P. Another possibility which is currently commercially available is to use a biconical dipole element to replace the lowest frequency elements.

While currently-available hybrid antennas are superior to LPDA antennas alone, they are still quite ineffective at the low-frequency end of their operating range. This weak performance at the low-frequency end imposes the amplifier requirements for an electric field generation system. Because the amplifier is generally the most costly component of the system, relaxing amplifier requirements would have a very significant effect on system cost.

Using dimensions and requirements typical for the EMC testing industry, we consider an antenna which occupies a 0.5 meter radius spherical volume, for which an electric field intensity of 20 V/m at 26 MHz is desired at a test distance of 3 meters from the antenna. It can be shown using radiation and power considerations that the theoretical lowest input power to achieve this performance is about 109 Watts. (It is assumed that the antenna exhibits a dipole radiation pattern.)

Currently available EMC testing antennas, however, require amplifiers of at least 500 Watts to achieve this performance.

It would therefore be desirable to develop more efficient broadband antennas for operating frequencies at which the antennas are electrically small.

SUMMARY OF THE INVENTION

The problems described above are addressed by a compact, electrically-small broadband antenna' which combines a folded, top-loaded antenna geometry using broadband radiating elements with a series capacitance applied at the antenna feed. The broadband radiating elements are used both as the antenna feed and as shunting (sometimes called "swamping") elements (giving rise to the "folded" geometry), and have a tapered form. Examples of these elements 'are bowtie or biconical elements. The folded geometry preferably includes an inductive load at the shunting element.

The top loading of the antenna may be obtained in any of several configurations. In general, a plate, or a wire-frame approximation to a plate, provides capacitance and also decreases the radiation Q of the dipole by increasing the current at its outer ends. This type of loading has been utilized for many years in unfolded antenna designs. In the antenna recited herein, the plate is attached to the above-described broadband radiating elements, such as bowties. A variety of orientations of the plate with respect to the broadband elements may be used. For example, the loading is believed to be most effective when an edge of the plate is attached to the shunting element such that an "F" configuration is obtained. Other plate orientations, such as one forming a symmetric "T" geometry with respect to the broadband elements, or one in which the plate is mounted asymmetrically, may also be used. Although these geometries are believed to provide slightly less effective loading than the "F" configuration, they are more effective than many currently-used designs, and the use of such a configuration may provide needed flexibility in meeting mechanical design constraints.

The combination of a folded geometry and top-loading as used in the antenna recited herein is believed to provide the antenna with a series resonance at a frequency for which the antenna is about one-tenth of a wave-lenth in length, and a parallel resonance at a frequency for which the antenna is close to one-half of a wave-length in length. Length as used herein refers to the distance between the ends farthest from the feed of the broadband radiating elements (if a dipole configuration is used), or between the ground plane and the end farthest from the feed of the broadband radiating element (if a single element in a monopole configuration is used). This length typically also corresponds to the distance between the top-loading elements (in a dipole configuration) or the distance between the top-loading element and the ground plane (in a monopole configuration). The operating band of the antenna may extend from approximately the series resonance frequency to about twice the parallel resonance frequency. For example, a typical operating band may extend from a frequency for which the antenna is about one-tenth of a wave-length long to a frequency for which the antenna is about two-thirds of a wave-length long. For an antenna which is 1.3 meters long, this would correspond to an operating band from about 25 MHz to about 150 MHz.

The parallel resonance exhibited by the folded antenna is positioned within the operating band of the antenna using tuning elements. Generally, the parallel resonance would be positioned fairly close to the lower limit of the operating range. In the vicinity of its parallel resonance, the radiation Q of the folded antenna is significantly lower than that of an unfolded (conventional) antenna at the same frequency. Therefore, this placement of the parallel resonance, combined with the use of a series capacitance at the input, results in significantly improved low-frequency performance of the antenna. The antenna is fed through series capacitors which essentially cancel the inductive reactance on the low side of the parallel resonance. Because the overall impedance level is high, an impedance transformer/balun will usually be required. In particular, a 50:200 ohm balun works well, with the source on the 50-ohm side and the antenna on the 200-ohm side.

The antenna recited herein may also be combined with an LPDA or other frequency-independent antenna to form an extremely broadband hybrid antenna. While the new broadband antenna given here provides a significant improvement in the performance of compact, broadband antennas, further improvement of the performance of the combination of this element with an LPDA may be provided by adding additional broadband elements, such as bowties, between the LPDA and the folded, top-loaded antenna. These additional elements help to cover the transition region between the LPDA and the new folded, top-loaded antenna.

DETAILED DESCRIPTION OF THE PREFERRED EMBODIMENTS

Figure 1:
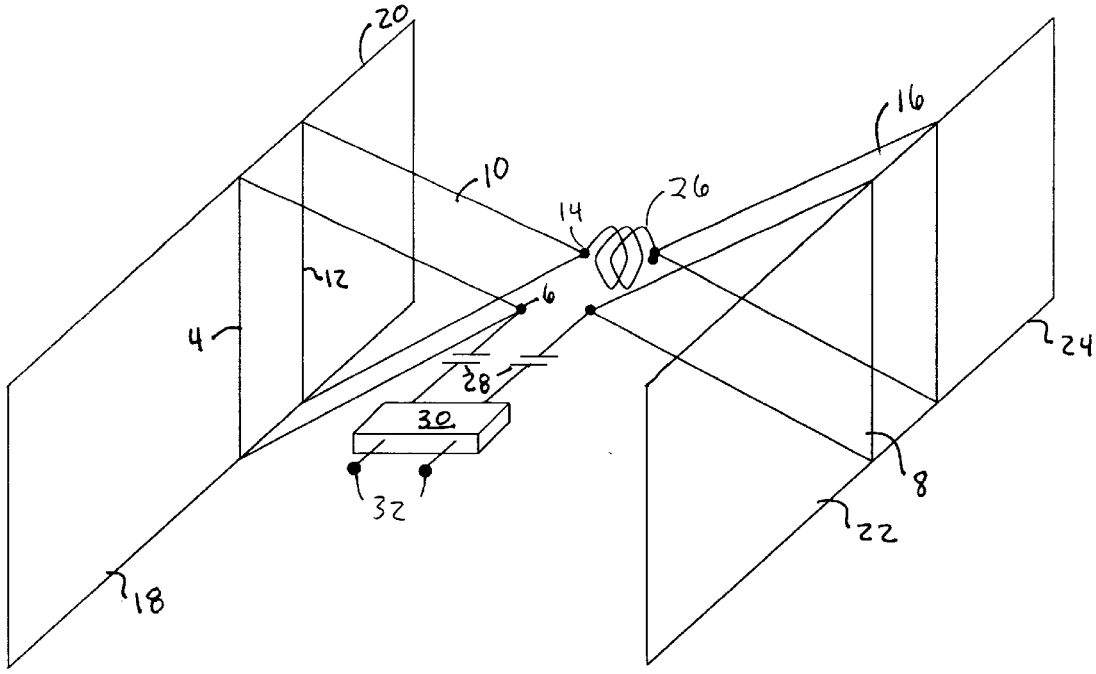
FIG. 1 Folded, top-loaded antenna with asymmetric top-loading elements.

Turning now to FIG. 1, an embodiment of the compact broadband antenna recited herein is shown. Each pair of triangular elements lying in the same plane comprises a bowtie dipole antenna. For example, first feed element 2 combines with second feed element 8 to form a bowtie dipole antenna, while first shunting element 10 combines with second shunting element 16 to form a bowtie dipole antenna. In this and the other embodiments given below, these elements may also be biconical antennas or other tapered antenna elements. The folded geometry is formed by using two bowtie dipole antennas, one which is used to feed the antenna at input connections 32 (through balun 30 and series capacitors 28, connected to apex 6 of feed element 2 and the corresponding apex of feed element 8), and the other which is a shunting element with an inductive load 26 connected between apex 14 of shunting element 10 and the corresponding apex of shunting element 16. Top loading is formed using rectangular elements 18 and 22 which connect the two bowtie elements at their outer edges, and extend beyond these elements to form capacity hats. For example, first top-loading element 18 connects to base edges 4 and 12 of first feed element 2 and first shunting element 10, respectively. Similarly, second top-loading element 22 connects to the corresponding base edges of second feed element 8 and second shunting element 16. In the embodiment of FIG. 1, portion 20 of top-loading element 18 extends outward from shunting element 10 in a direction away from feed element 2. Similarly, portion 24 of top-loading element 22 extends outward from shunt element 16 in a direction away from feed element 8. In this and the other embodiments given below the bowtie and top-loading elements may be either conducting planar sheets, planar mesh, or planar frames.

In an alternative embodiment of the antenna of FIG. 1, the top-loading elements are connected symmetrically to the tapered shunt and feed elements to form "T" geometries.

Figure 2:
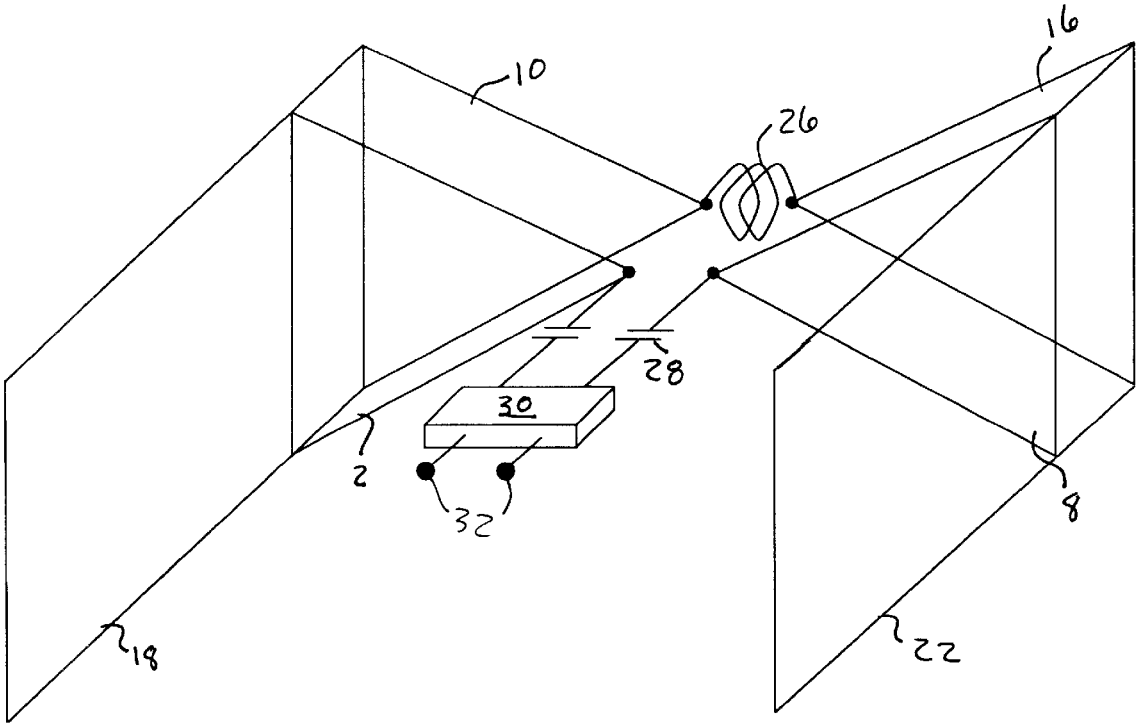
FIG. 2 Folded, top-loaded antenna with top-loading elements in "F" configuration.

In another alternative embodiment, shown in FIG. 2, the top-loading elements are connected so that they extend beyond the connections with the feeding bowtie element, but do not extend beyond the connections with the shunting bowtie element, to give "F" configurations.

Figure 3:
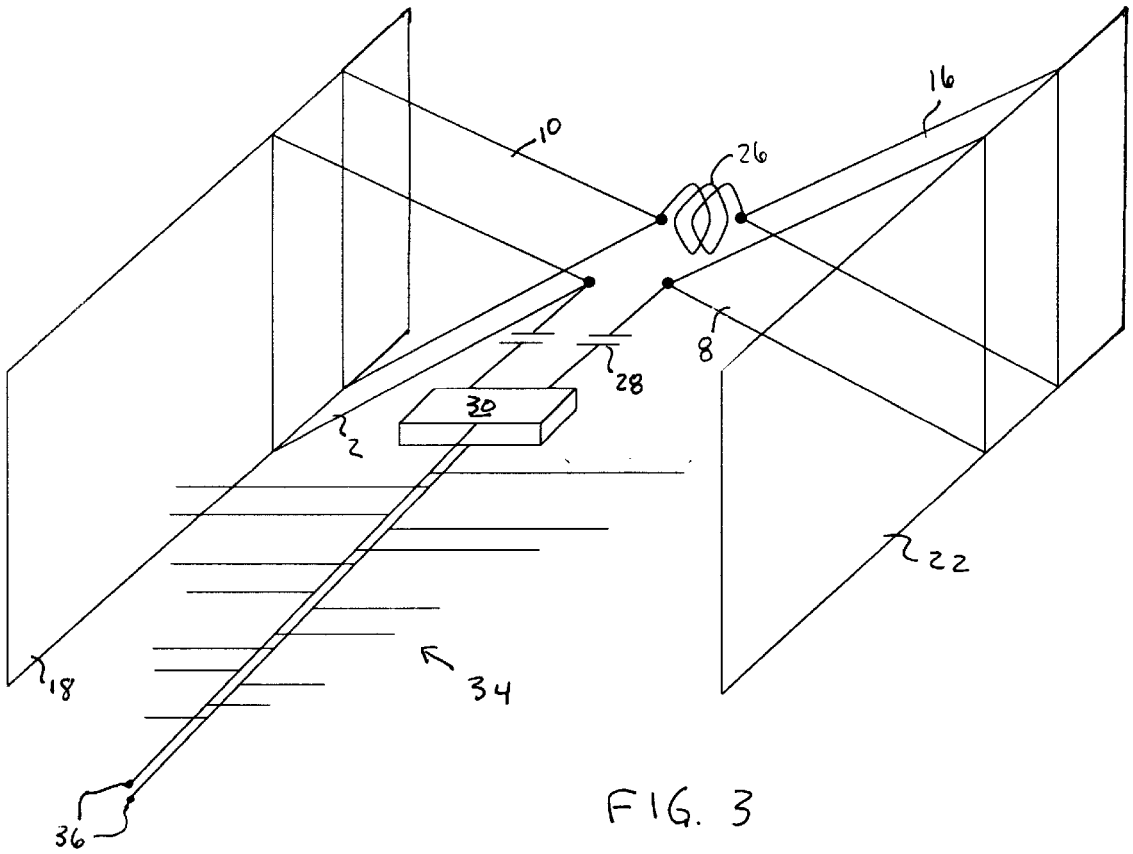
FIG. 3 Folded, top-loaded antenna with top-loading elements, combined with LPDA to form hybrid broadband antenna.

In another embodiment of the invention, shown in FIG. 3, the folded, top-loaded antenna is combined with LPDA 34 to form an extremely broadband hybrid antenna. Other frequency-independent antennas may be used in the place of the LPDA. The top-loading elements may be connected in any of the configurations described herein, such as an "F" configuration, or a symmetric or asymmetric "T" configuration.

Figure 4:
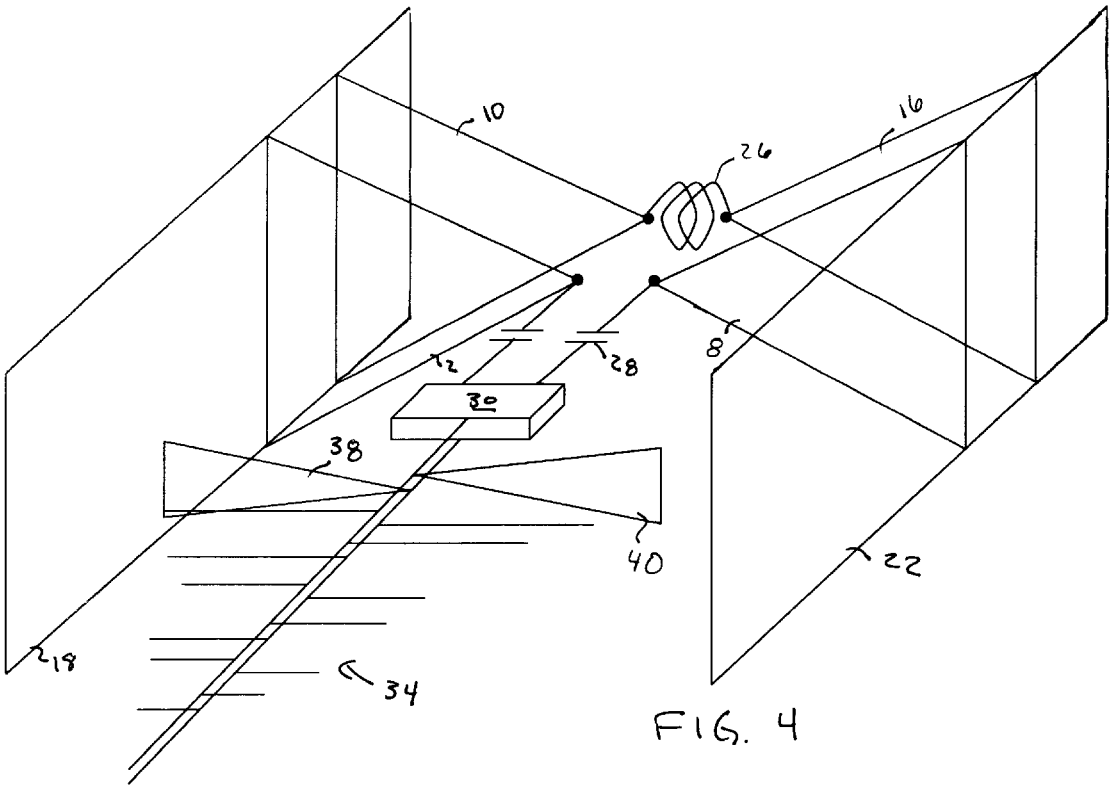
FIG. 4 Hybrid antenna as shown in FIG. 3 with additional bowtie elements.

In another embodiment of the invention, shown in FIG. 4, an additional pair of bowtie elements, elements 38 and 40, is added to the antenna of FIG. 3, between the LPDA and the folded, top-loaded antenna. The additional elements may be used to improve the performance of the antenna in the "crossover" frequency range between the low-frequency range covered by the folded, top-loaded antenna and the high-frequency range covered by the LPDA. The additional bowtie elements may also be biconical or other tapered antenna elements. As in FIG. 3, the top-loading elements may be connected in an "F" configuration or in symmetric or asymmetric "T" configurations.

Figure 5:
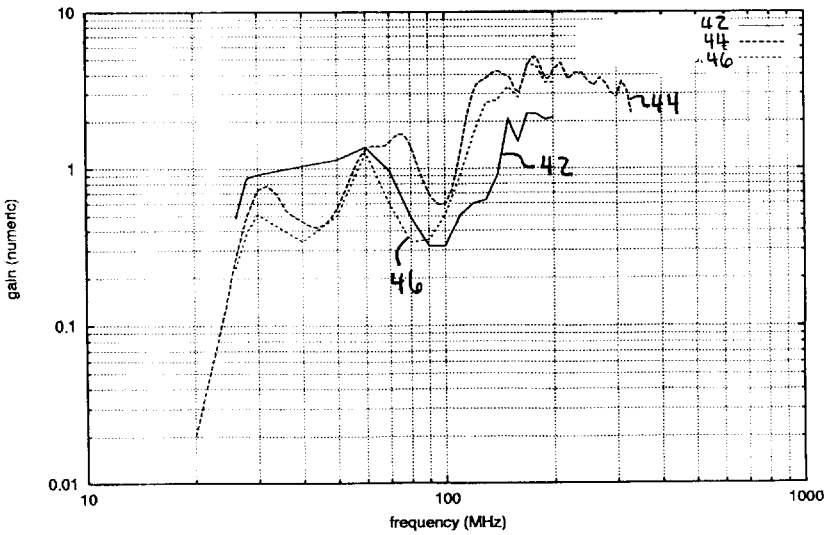
FIG. 5 Measured gain vs. frequency for prototypes of folded, top-loaded antenna in "F" configuration, antenna combined with LPDA, and antenna combined with LPDA and additional bowtie elements.
Figure 6:
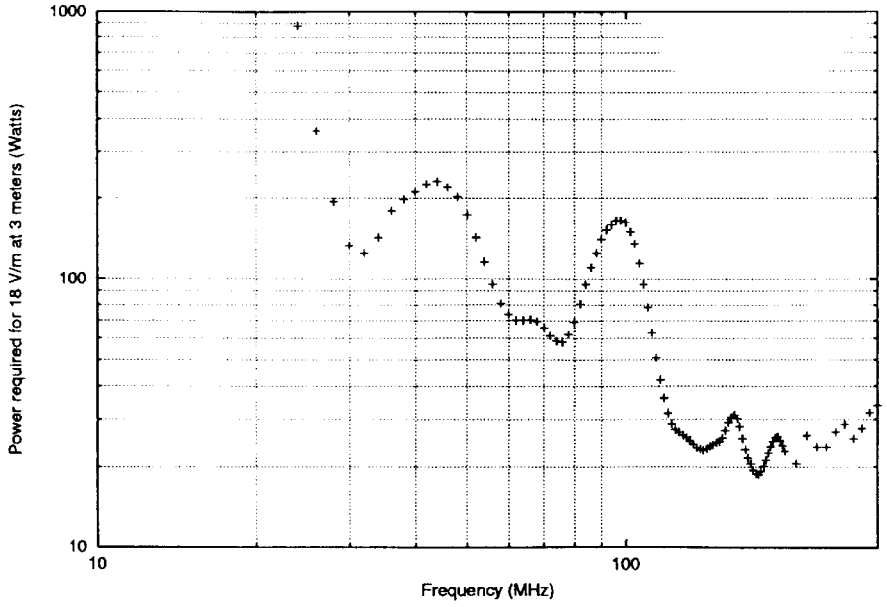
FIG. 6 Power required to produce a field of 18 V/m at a distance of 3 meters using the folded, top-loaded antenna in an "F" configuration, combined with LPDA and additional bowtie elements.

Experimental results for prototype versions of the antennas of FIG. 1, FIG. 3, and FIG. 4 are shown in FIG. 5 and FIG. 6. In FIG. 5, the gain vs. frequency for three of the antennas is shown. Curve 42 shows the gain of a folded, top-loaded, antenna as shown in FIG. 1. Curve 44 is for this antenna combined with an LPDA, as shown in FIG. 3, and curve 46 is for the combined antenna with additional bowtie elements, as shown in FIG. 4. For the low-frequency range which is critical in determining the amplifier size needed for the system, the gain of these antennas is believed to be higher than any commercially available. In FIG. 6, the input power required to produce a field of 18 V/m at a point 3 meters in front of the antenna using the hybrid antenna with additional elements is shown.

The prototype broadband antenna built and measured for FIGS. 5 and 6 was of the "F" type. The antenna used bowtie elements with a 60 degree opening angle, essentially equilateral triangles 28.86 inches on a side. These bowtie elements were realized with a wireframe approximation; welded, 1-inch-square 6061-T651 aluminum alloy tubing was employed. The top loading was obtained using 0.062-inch-thick 3003 aluminum alloy sheet. The sheets were cut to the same height as the bowties (25 inches). They extended 30 inches from the front bowtie. The center-to-center distance between the bowties was 6 inches and the bowties were connected at the outer edges by extending the top loading plate all the way to the back bowties. This gave a total length of 37 inches front to back. The width of the prototype was 51 inches; this allowed a 1 inch feed gap between the bowtie elements. The inductor connected across the two rear bowties was 200 nH and was formed with coiled 0.125-inch-diameter aluminum tubing. The series capacitors connected at the input were 30 pF ceramic disk type.

Figure 7:
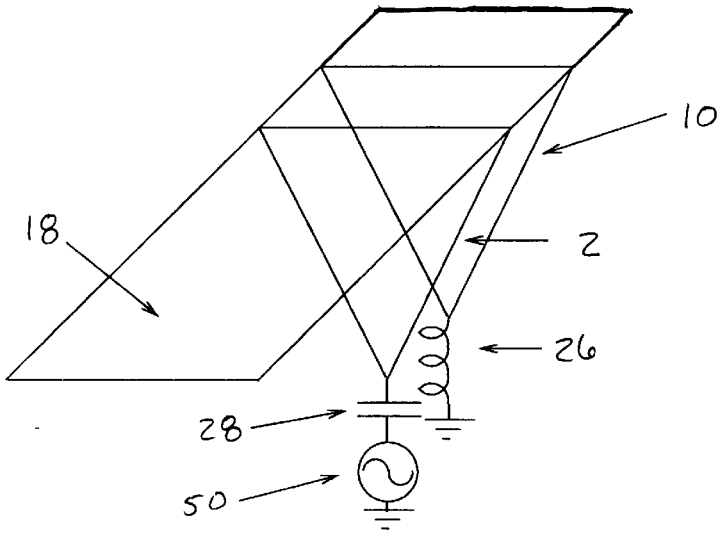
FIG. 7 Single-ended version of folded, top-loaded antenna to be used over conducting ground plane.

In an alternative embodiment, shown in FIG. 7, a single-ended version of the antenna may be used over a conducting ground plane (such as a vehicle body) to give similar performance to that of the balanced version shown in FIGS. 1–4. In this case, the two tapered elements 2 and 10 are broadband monopoles, rather than dipoles, and only one top-loading element 18 is needed. The inductive load 26 is connected between the shunting monopole element 10 and the ground plane, and a signal source 50 is connected between the ground plane and the series capacitance 28 of the feed broadband monopole element 2. An impedance transformer may also be used in series with the input As in the two-sided, or balanced, version described in the above embodiments, and for all other embodiments described below, the antenna elements may be planar sheets, planar mesh, or planar frames, and the broadband monopoles may be bowtie, biconical, or other tapered elements. In addition, the top-loading element 18 may be connected in an "F" configuration or in symmetric or asymmetric "T" configurations.

Figure 8:
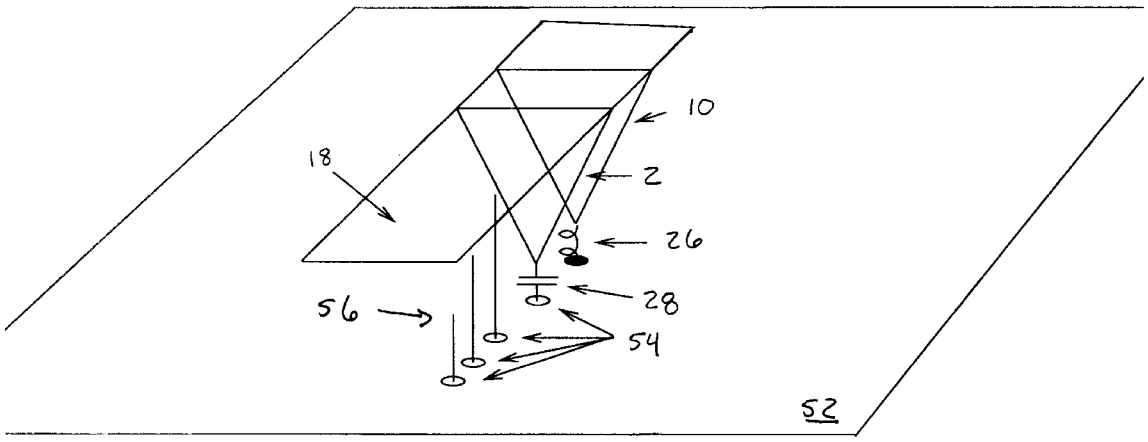
FIG. 8 Single-ended version of folded, top-loaded antenna combined with log-periodic monopole array, to give hybrid antenna with same performance as balanced antenna combined with log-periodic dipole array.

In another embodiment, shown in FIG. 8, a log periodic monopole array (LPMA)56 is combined with the antenna of FIG. 7, to form a broadband hybrid single-ended antenna over a ground plane. Other single-ended frequency-independent antennas may be used in place of the LPMA, and top-loading element 18 may be connected in an "F" configuration or in symmetric or asymmetric "T" configurations.

Figure 9:
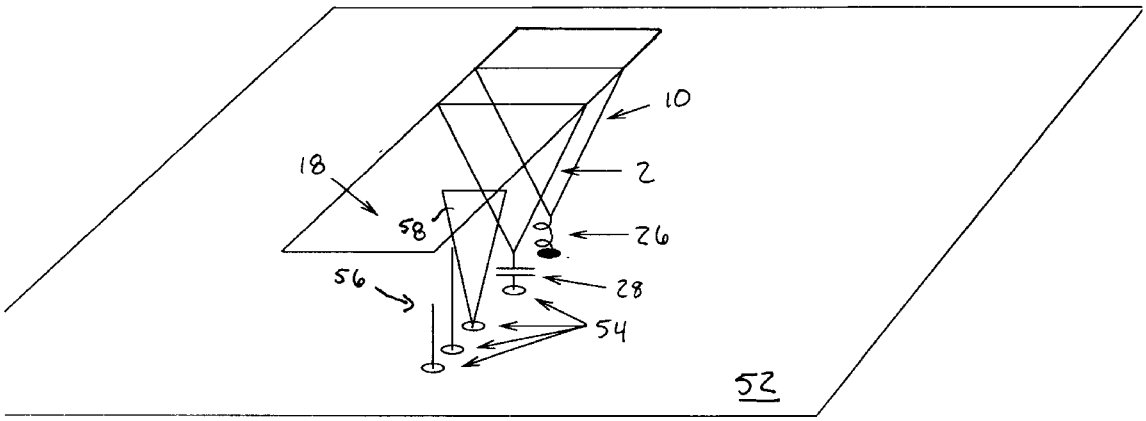
FIG. 9 Single-ended version of hybrid antenna with additional bowtie element.

In another embodiment, shown in FIG. 9, one or more additional broadband elements 58, such as bowtie monopoles, may be added between LPMA 56 and the folded, top-loaded antenna. The additional elements are used to improve the performance of the antenna in the "cross-over" frequency range between the low-frequency range covered by the folded, top-loaded antenna and the high-frequency range covered by the LPMA. The additional bowtie elements may also be biconical or other tapered antenna elements. As in FIG. 8, the top-loading elements may be connected in an "F" configuration or in symmetric or asymmetric "T" configurations.

All of the antennas disclosed and claimed herein can be made and used without undue experimentation in light of the present disclosure. While the antennas have been described in terms of preferred embodiments, it will be apparent to those skilled in the relevant art that variations may be applied to the antennas described herein without departing from the concept, spirit and scope of the invention.

More specifically, it will be apparent that distortions of the shape of the antenna elements such as flaring or tapering of the top-loading elements, additional loading schemes such as resistive loading of the elements to alter the current distribution on them, and additional tuning elements may be substituted for or added to the elements described herein while the same or similar results would be achieved. All such similar substitutes and modifications apparent to those skilled in the art are deemed to be within the spirit, scope and concept of the invention as defined by the appended claims.

What is claimed is:

1. An antenna, comprising:

a first tapered feed element having a base and an opposing apex, wherein the apex is adapted for coupling to an antenna input signal;

a first tapered shunting element having a base and an opposing apex, wherein the first shunting element is laterally displaced from and substantially parallel to the first feed element; and a first top-loading element arranged substantially perpendicular to the first feed and first shunting elements, wherein the first top-loading element is connected to the base of the first feed element and the base of the first shunting element, and wherein a portion of the first top-loading element extends outward from the first shunting element in a direction away from the first feed element.

2. The antenna as recited in claim 1, further comprising an input tuning circuit coupled between the apex of the first feed element and the input signal.

3. The antenna as recited in claim 2, wherein said input tuning circuit comprises a capacitor.

4. The antenna as recited in claim 1, wherein said first tapered feed element and said first tapered shunting element comprise triangular elements.

5. The antenna as recited in claim 1, wherein said first top-loading element comprises a rectangular element.

6. The antenna as recited in claim 1, wherein said first feed element, said first shunting element and said first top-loading element comprise a conductive material.

7. The antenna as recited in claim 6, wherein said conductive material comprises a metal.

8. The antenna as recited in claim 1, wherein said first feed, first shunting, and first top-loading elements comprise conductive planar frames.

9. The antenna as recited in claim 1, wherein said first feed, first shunting, and first top-loading elements comprise conductive planar sheets.

10. The antenna as recited in claim 1, wherein said first feed, first shunting, and first top-loading elements comprise conductive planar mesh.

11. The antenna as recited in claim 1, wherein a portion of said first top-loading element extending outward from the first feed element in a direction away from the first shunting element has substantially the same size as the portion of the first top-loading element extending outward from the first shunting element in a direction away from the first feed element.

12. The antenna as recited in claim 1, wherein said antenna is adapted for placement over a ground plane, and wherein said placement comprises:

coupling the apex of the first shunting element to the ground plane; and coupling the apex of the first feed element to the input signal, wherein said coupling the apex of the first feed element to the input signal comprises coupling through an opening in the ground plane.

13. The antenna as recited in claim 12, wherein said ground plane comprises a conductive surface.

14. The antenna as recited in claim 12, further comprising a loading circuit coupled between the apex of the first shunting element and the ground plane.

15. The antenna as recited in claim 14, wherein said loading circuit comprises an inductor.

16. The antenna as recited in claim 12, further comprising a log-periodic monopole array coupled between the apex of the first feed element and the input signal.

17. The antenna as recited in claim 16, further comprising a broadband tapered element coupled between the apex of the first feed element and the log-periodic monopole array.

18. The antenna as recited in claim 1, further comprising:

a second tapered feed element having a base and an opposing apex, wherein the apex of the second feed element is adapted for coupling of an input signal between the apex of the second feed element and the apex of the first feed element;

a second tapered shunting element having a base and an opposing apex, wherein the second shunting element is substantially parallel to the second feed element, and wherein a distance between the second shunting and second feed elements is substantially equal to a distance between the first shunting and first feed elements, and wherein the apex of the second shunting element is coupled to the apex of the first shunting element;

a second top-loading element arranged substantially perpendicular to the second shunting and second feed elements, and substantially parallel to the first top-loading element, wherein the second top-loading element is connected to the base of the second shunting element and the base of the second feed element, such that the first and second shunting elements and the first and second feed elements are arranged between the first and second top-loading elements, and wherein a portion of the second top-loading element extends outward from the second shunting element in a direction away from the second feed element.

19. The antenna as recited in claim 18, further comprising a loading circuit coupled between the apex of the first shunting element and the apex of the second shunting element.

20. The antenna as recited in claim 19, wherein said loading circuit comprises an inductor.

21. The antenna as recited in claim 18, further comprising a log-periodic dipole array coupled to the apex of the first feed element and the apex of the second feed element, wherein the input signal is coupled to the log-periodic dipole array.

22. The antenna as recited in claim 21, further comprising a first broadband tapered element coupled between the apex of the first feed element and the log-periodic dipole array, and a second broadband tapered element coupled between the apex of the second feed element and the log-periodic dipole array.

* * * * *